US005651642A

United States Patent [19]

Kelley, Jr. et al.

[11] Patent Number: 5,651,642

[45] Date of Patent: Jul. 29, 1997

[54] CONCRETE BUILDING BLOCKS

[76] Inventors: Michael L. Kelley, Jr.; Michael L. Kelley, Sr., both of 3120 Freeman Rd. E., Puyallup, Wash. 98371

[21] Appl. No.: 406,116

[22] Filed: Mar. 17, 1995

[51] Int. Cl.[6] ..... E04B 2/02; E04C 1/00; B66C 1/66

[52] U.S. Cl. ..... 405/286; 405/284; 52/604; 52/608; 52/561; 52/592.5; 52/592.6; 52/125.4; 52/125.5

[58] Field of Search ..... 405/284, 286; 52/604, 608, 561, 569, 570, 125.4, 125.5, 592.1, 592.4–592.6; 446/128, 125, 124, 122, 116, 104; 47/66

[56] References Cited

U.S. PATENT DOCUMENTS

| | | | |
|---|---|---|---|
| 689,523 | 12/1901 | Trumbull . | |
| 802,566 | 10/1905 | Harris . | |
| 1,959,816 | 12/1934 | Crum . | |
| 1,968,393 | 6/1934 | Henderson . | |
| 1,992,785 | 2/1935 | Steuer . | |
| 2,262,130 | 11/1941 | Bagley . | |
| 2,344,206 | 3/1944 | Forni | 52/125.4 X |
| 2,644,327 | 7/1953 | Clements . | |
| 2,703,487 | 3/1955 | Ossoinack . | |
| 2,826,906 | 3/1958 | Rice . | |
| 3,116,570 | 1/1964 | Torricelli . | |
| 3,176,468 | 4/1965 | Nagai et al. . | |
| 3,305,982 | 2/1967 | Steele . | |
| 3,605,322 | 9/1971 | Matusbayshi et al. | 446/128 |
| 3,676,971 | 7/1972 | Dombroski . | |
| 3,894,397 | 7/1975 | Fair . | |
| 3,998,423 | 12/1976 | Mullins . | |
| 4,031,678 | 6/1977 | Schuring . | |
| 4,078,760 | 3/1978 | Mullins . | |
| 4,093,174 | 6/1978 | Mullins . | |
| 4,186,540 | 2/1980 | Mullins . | |
| 4,187,069 | 2/1980 | Mullins . | |
| 4,262,951 | 4/1981 | Hoyers . | |
| 4,385,563 | 5/1983 | Heggenstaller . | |
| 4,436,447 | 3/1984 | Crowe . | |
| 4,521,138 | 6/1985 | Steiner | 52/608 X |
| 4,522,001 | 6/1985 | Meyer | 446/128 X |
| 4,671,039 | 6/1987 | Hunt . | |
| 4,833,856 | 5/1989 | Zwagerman . | |
| 4,914,876 | 4/1990 | Forsberg | 405/286 X |
| 4,920,712 | 5/1990 | Dean, Jr. . | |
| 4,964,761 | 10/1990 | Rossi | 405/286 |
| 4,965,979 | 10/1990 | Larrivee et al. | 52/608 X |
| 5,003,746 | 4/1991 | Wilston | 52/608 X |
| 5,020,667 | 6/1991 | Bush . | |
| 5,154,032 | 10/1992 | Ritter | 52/608 X |
| 5,255,614 | 10/1993 | Voss-Schrader et al. . | |
| 5,402,609 | 4/1995 | Kelly, Jr. | 52/570 X |
| 5,421,135 | 6/1995 | Stephens et al. | 52/604 |

FOREIGN PATENT DOCUMENTS 1292136 of 0000 United Kingdom .

*Primary Examiner*—Robert Canfield

*Attorney, Agent, or Firm*—Delbert J. Barnard; Kathleen T. Petrich

[57] ABSTRACT

A concrete building block (10) having a top (12), a bottom (14), substantially identical first and second end portions (16, 18) and a central portion (20). First and second end portions (16, 18) each have a connector pin (28, 34) and a complementary connector socket (30, 36), where each connector pin and connector socket generate about a vertical axis of generation (A1, A2). The block (10) also includes a lifting eye (46) that projects upwardly from a well (50) and a decorative surface (56) of vertical ridges and valleys on at least the first side (22), and a first and second end surfaces (26, 32). An alternate block (11) includes a circular top (58), a circular bottom (60), and a sidewall (62). Block (11) also includes a connector pin (64), a complementary connector socket (66) and a vertical axis of generation A3, of which connector pin (64) and connector socket (66) generate about, and a means for engaging block 11 with a lifting device. Block (11) also includes a decorative surface (68) that adorns sidewall (62). A plurality of blocks (10, 11) are mounted one atop another without mortar to form a wall (100) that can be designed to include any desired angle or curve.

16 Claims, 6 Drawing Sheets

CONCRETE BUILDING BLOCKS

TECHNICAL FIELD

The present invention relates to concrete building blocks, and, more particularly, to the provision of stackable concrete building blocks connected together by circular pin and socket connections that permit a rotational stacking of the blocks to form a wall of any desired angle or curve.

Related Applications

This application is related to my co-pending application "Concrete Building Block System," Ser. No. 08/369,118 filed Jan. 5, 1995, which is a divisional patent application of Ser. No. 07/929,726 filed Aug. 13, 1992, and also entitled "Concrete Building Block System."

BACKGROUND OF THE INVENTION

Concrete building blocks are widely used in the construction of a variety of structures. A major use of such blocks is the building of temporary or permanent retaining walls. Blocks used in such walls commonly have interlocking upper and lower surfaces in order to automatically interlock a block when positioned atop another block. This automatic interlocking allows the walls to be built without mortar to expedite the building process and to permit the walls to be disassembled, if desired, when the walls are no longer required. Square, rectangular, and angle-shaped building blocks including interlocking square-like projections and recesses are disclosed in my aforementioned co-pending application Ser. No. 08/369,118. These blocks allow for mortar-less stackability, but require the use of angle blocks, or special curved pieces, to achieve an angled or curved wall. Obtaining all of the various individual building block pieces for a complicated design can be expensive, space-consuming, and time-consuming.

An object of this invention is to provide a one-piece concrete building block that can form a wall configuration of many varied angles and/or curves, thus, providing greater design flexibility and improved inventory control.

SUMMARY OF THE INVENTION

The concrete building block of the present invention is basically characterized by substantially identical first and second end portions, a top and a bottom. Each end portion has a generally semi-cylindrical end surface. The block has at least one connector pin projecting upwardly from the top, a complementary first connector socket entering into the bottom, at least one vertical axis of generation about which the pin, the socket and at least one end surface are generated.

A first building block embodiment of the invention includes substantially identical first and second end portions, the central portion between the end portions, a first side, a second side, a top and a bottom. The first end portion has a generally semi-cylindrical first end surface, a first connector pin projecting upwardly from said top, and a complementary first connector socket entering into said bottom. The first end portion also includes a vertical first axis of generation about which the first end, the first socket, and the first end surface are generated. The second end portion has a generally semi-cylindrical second end surface, a second connector pin projecting upwardly from the top and a complementary second connector socket entering into the bottom. The second end portion also includes a vertical second axis of generation about which the second pin, the second socket, and the second end surface are generated.

In preferred form, the block further includes a lifting eye that projects upwardly from a well is formed in the top of the block. Another embodiment includes a lifting eye that projects upwardly from a well that is formed from the top of each pin. A decorative surface adorns at least the first side and first and second end surfaces. In preferred form, the decorative surface comprises of a plurality of vertical ridges and valleys.

A second building block embodiment of the invention has a generally cylindrical body, a top, a bottom and a cylindrical sidewall. A single connector pin projects upwardly from the top and a single complementary socket enters into the bottom. The block has a single vertical axis of generation about which the pin, the socket and the cylindrical sidewall are generated.

Another aspect of this invention is the provision of a wall formed from a plurality of the building blocks. In preferred form, the wall is comprised of both the first and second embodiments of the building block.

Another aspect of this invention includes the block and its alternate embodiment with a flat top surface to provide a finished appearance as a top layer of the wall, as well as another alternate block with a hollow interior.

Advantages of this invention are 1) a multiplicity of variations for stacking the blocks one atop another, 2) ability to create a wall of virtually any angle or curve design, 3) reduced variety of blocks required for inventory, and 4) a decorative surface on each exposed side surface of each block.

These and other advantages and features will become apparent from a review of the following detailed description of the best mode for carrying out the invention, the drawing, and the claims, all of which comprise of the present invention and are herein included by reference.

DESCRIPTION OF THE DRAWING

Like reference numerals are used to designate like parts through out the several views of the drawing, and.

BEST MODE OF THE INVENTION

Figure 5:
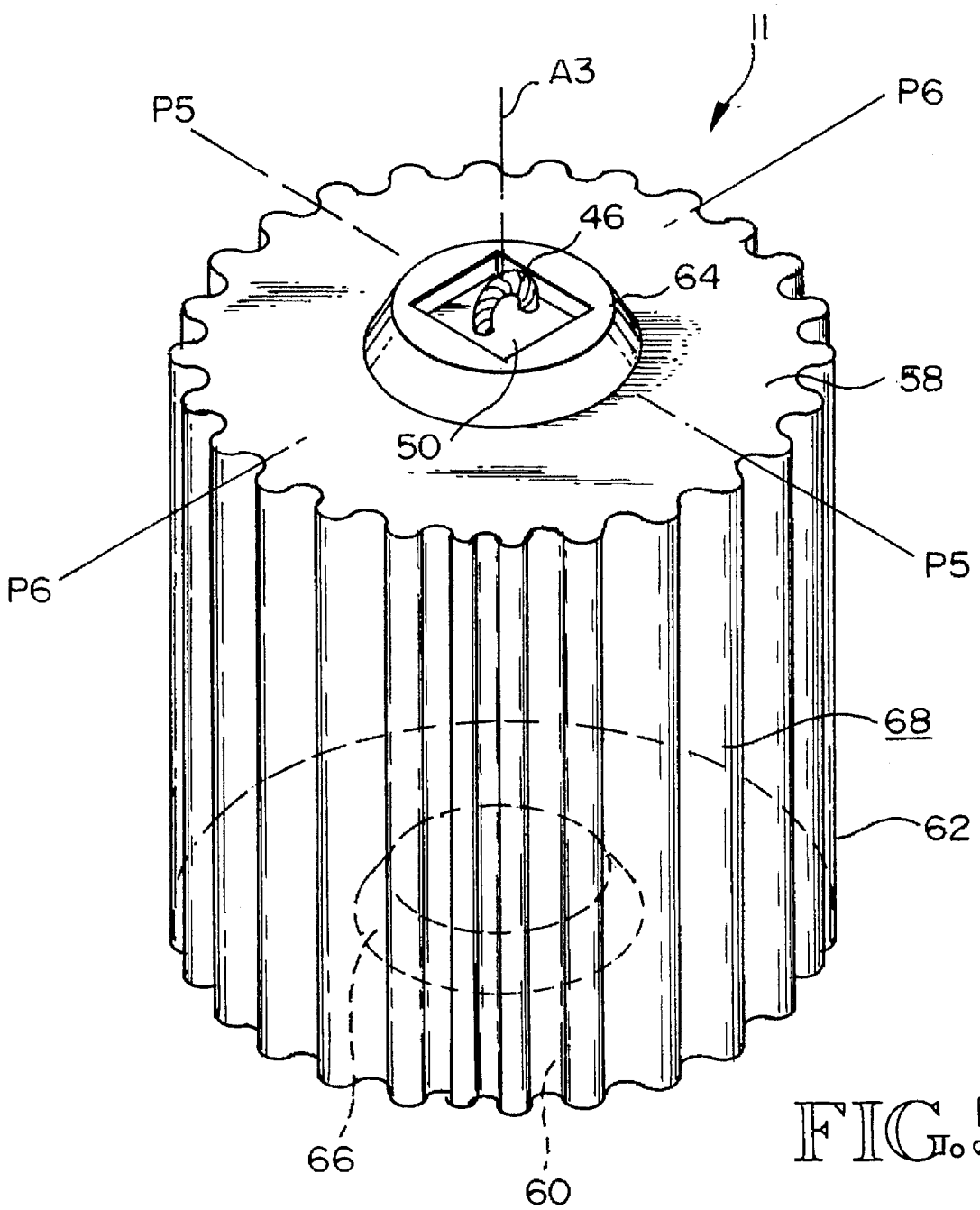
FIG. 5 is a view like FIG. 1 but of an alternate form of the block.
Figure 6:
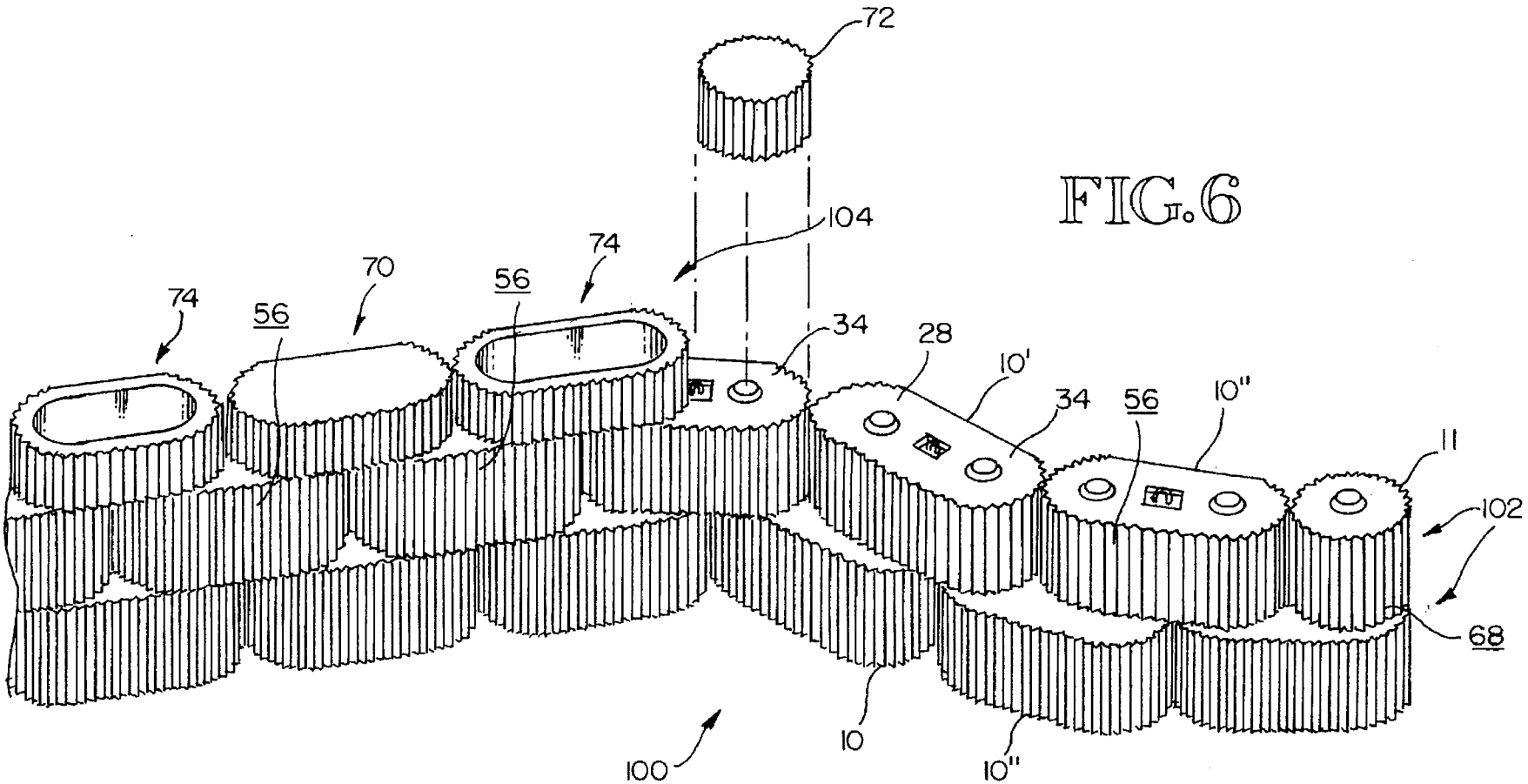
FIG. 6 is a pictorial view of a wall formed from blocks depicted in FIG. 1 and FIG. 5, and depicting an exploded view of a block like FIG. 5, and depicting a partial top layer with blocks with flat top surfaces, and other alternate blocks with hollow interiors.

Referring to the drawing, FIGS. 1–4 show a block 10 that is the basic block of the invention. This block is horizontally elongated and has a connection system at each end. FIG. 5 shows a second block 11, which is cylindrical in shape and has a single connection system. FIG. 6 shows the blocks 10, 11 stacked together to form a wall.

Figure 1:
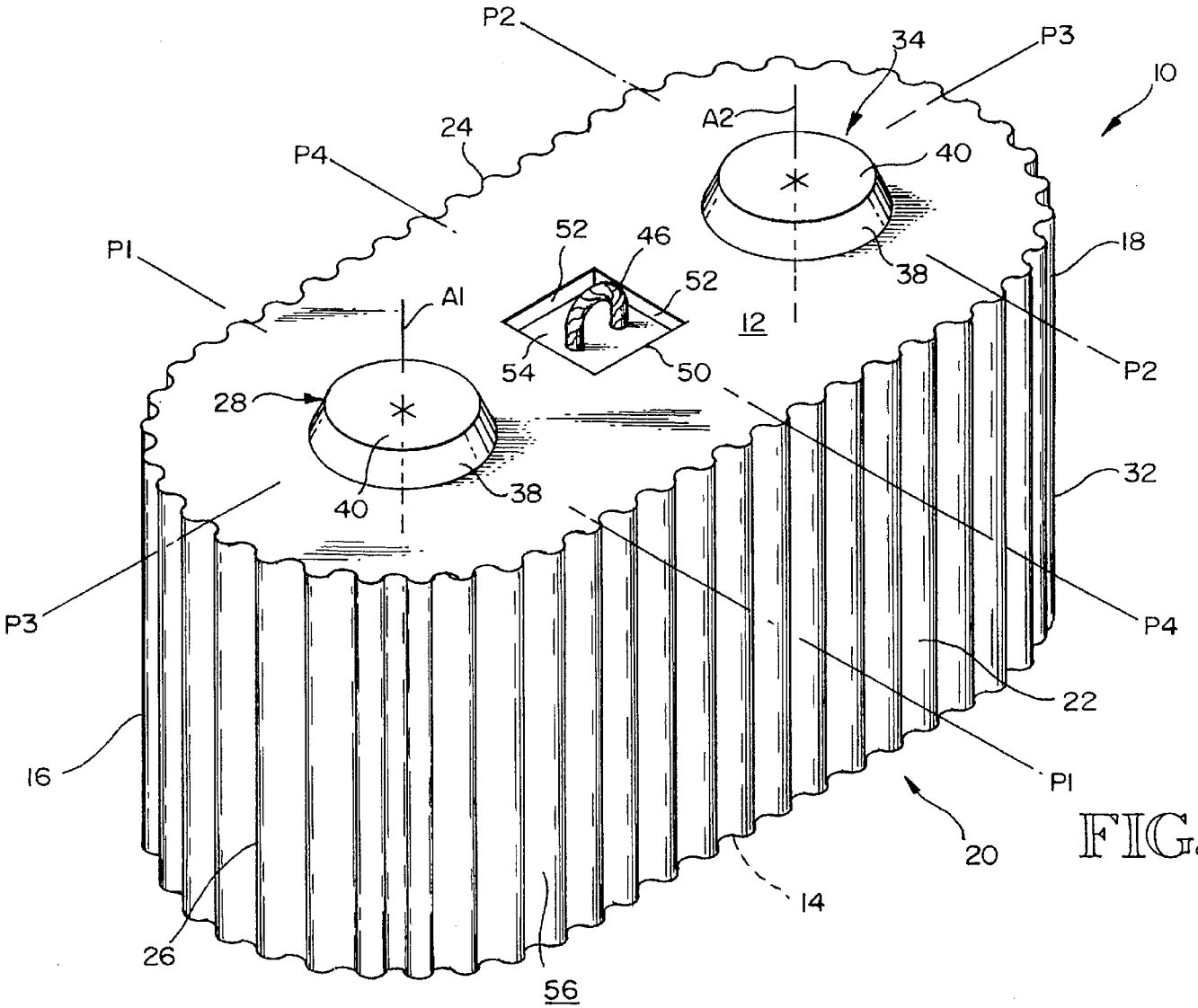
FIG. 1 is a pictorial view incorporating the invention, such view being taken from above and looking towards the top, one end and one side of the block.
Figure 2:
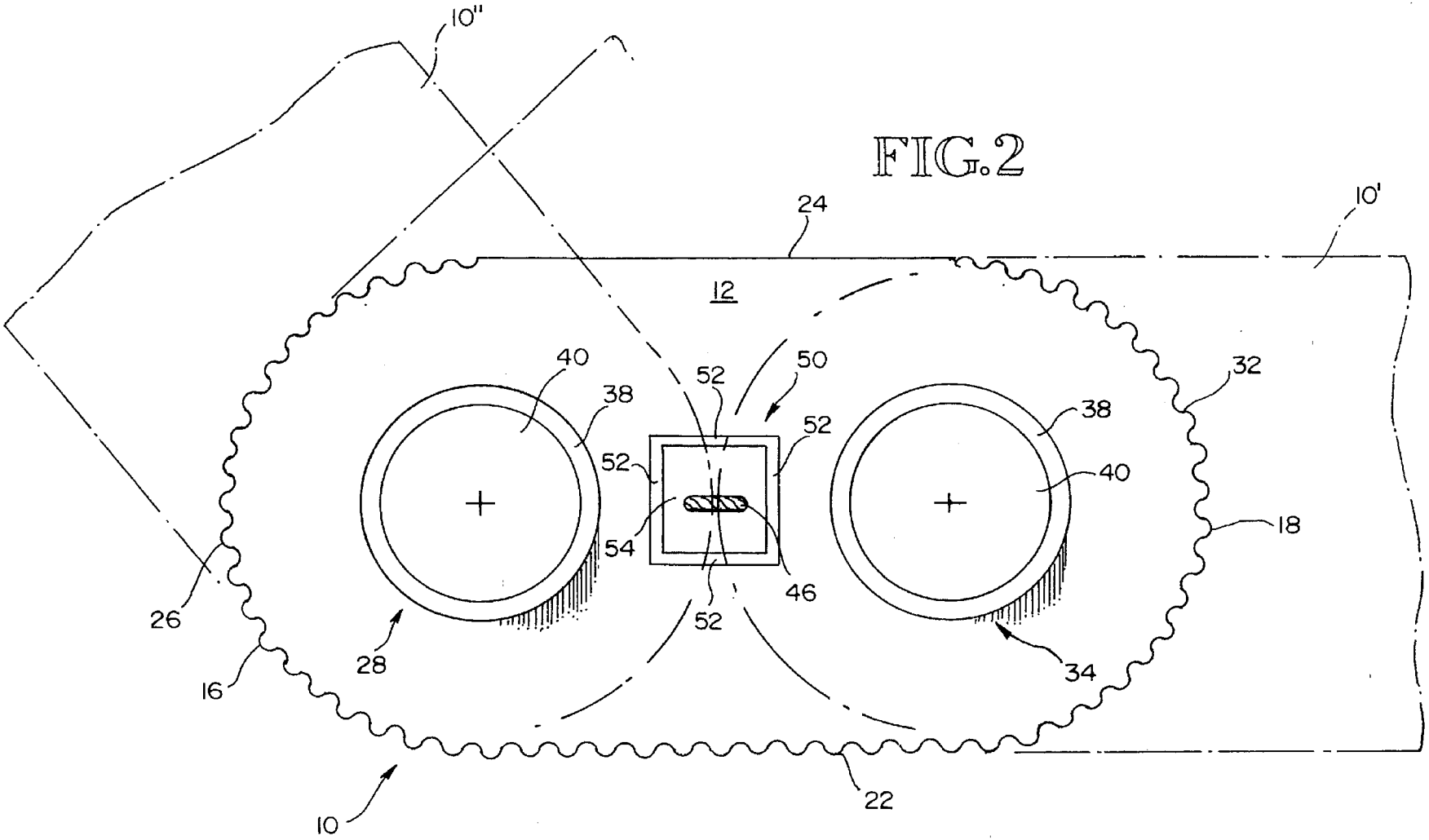
FIG. 2 is a top plan view of the block shown in FIG. 1, including phantom line showings of an in-line second block and an angled third block.
Figure 3:
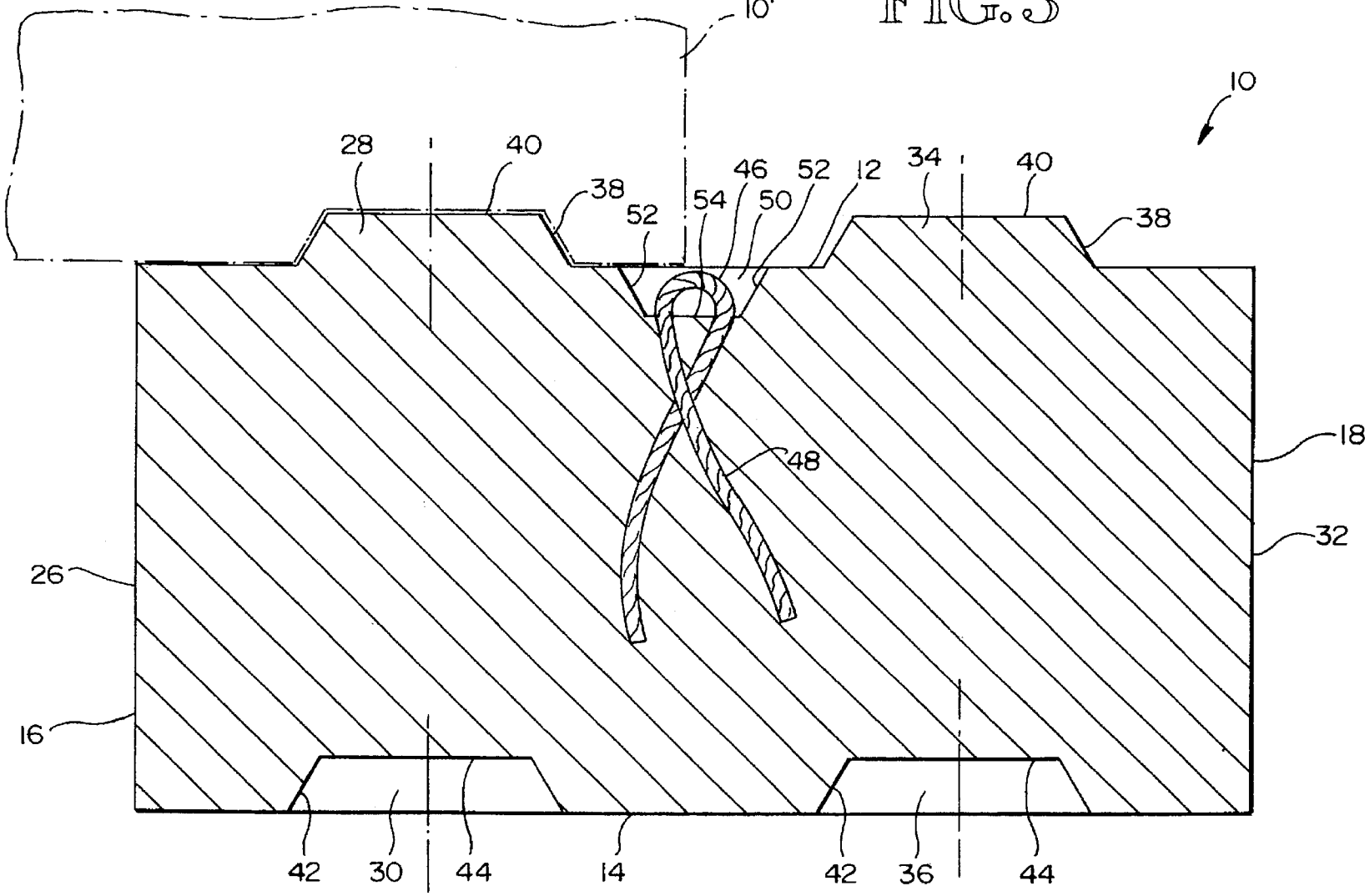
FIG. 3 is a longitudinal sectional view of the block of FIG. 1 taken substantially along lines P3—P3 of FIG. 1, such view including a fragmentary phantom showing of a second block.

Referring now to FIGS. 1–4, block 10 has substantially identical first and second end portions 16, 18, a central portion 20 between the end portions 16, 18, first and second sides 22, 24, a top 12 and a bottom 14. The first end portion 16 has a generally semi-cylindrical first end surface 26, a first connector pin 28 projecting upwardly from the top 12, and a complementary first connector socket 30 entering into the bottom 14 (FIG. 3). First end portion 16 also includes a vertical first axis of generation A1 about which the first pin 28, the first socket 30, and the first end surface 26 are generated.

In identical manner, the second end portion 18 has a generally semi-cylindrical second end surface 32, a second connector pin 34 projecting upwardly from the top 12, and a complementary second connector socket 36 entering into the bottom 14 (FIG. 3). The second end portion further includes a vertical second axis of generation A2 about which the second pin 34, the second socket 36 and the second end surface 32 are generated. Herein, the term "semi-cylindrical" for the first and second end surfaces 26, 32 also includes a plurality of sides that when taken in its totality give the appearance of being semi-cylindrical.

Axes of generation A1, A2, are spaced apart longitudinally of block 10. Axis A1 is within a transverse first vertical plane P1—P1. Axis A2 is within a second transverse vertical planes P2—P2. Plane P1—P1 is at the boundary between first end portion 16 and a central portion 20. Plane P2—P2 is at the boundary between second end portion 18 and central portion 20. Axes A1, A2 are also located within a vertical longitudinal plane P3—P3. Plane P3—P3 extends across first end portion 16, second end portion 18 and central portion 20 and divides block 10 in half in the transverse direction, such that block 10 (less the design) has mirror-like symmetry on opposite sides of vertical longitudinal plane P3—P3. Block 10 is also symmetrical about a transverse vertical plane P4—P4. Plane P4—P4 extends across central portion 20 and divides block 10 in half in the longitudinal direction, such that block 10 has mirror-like symmetry on opposite sides of vertical plane P4—P4.

Figure 4:
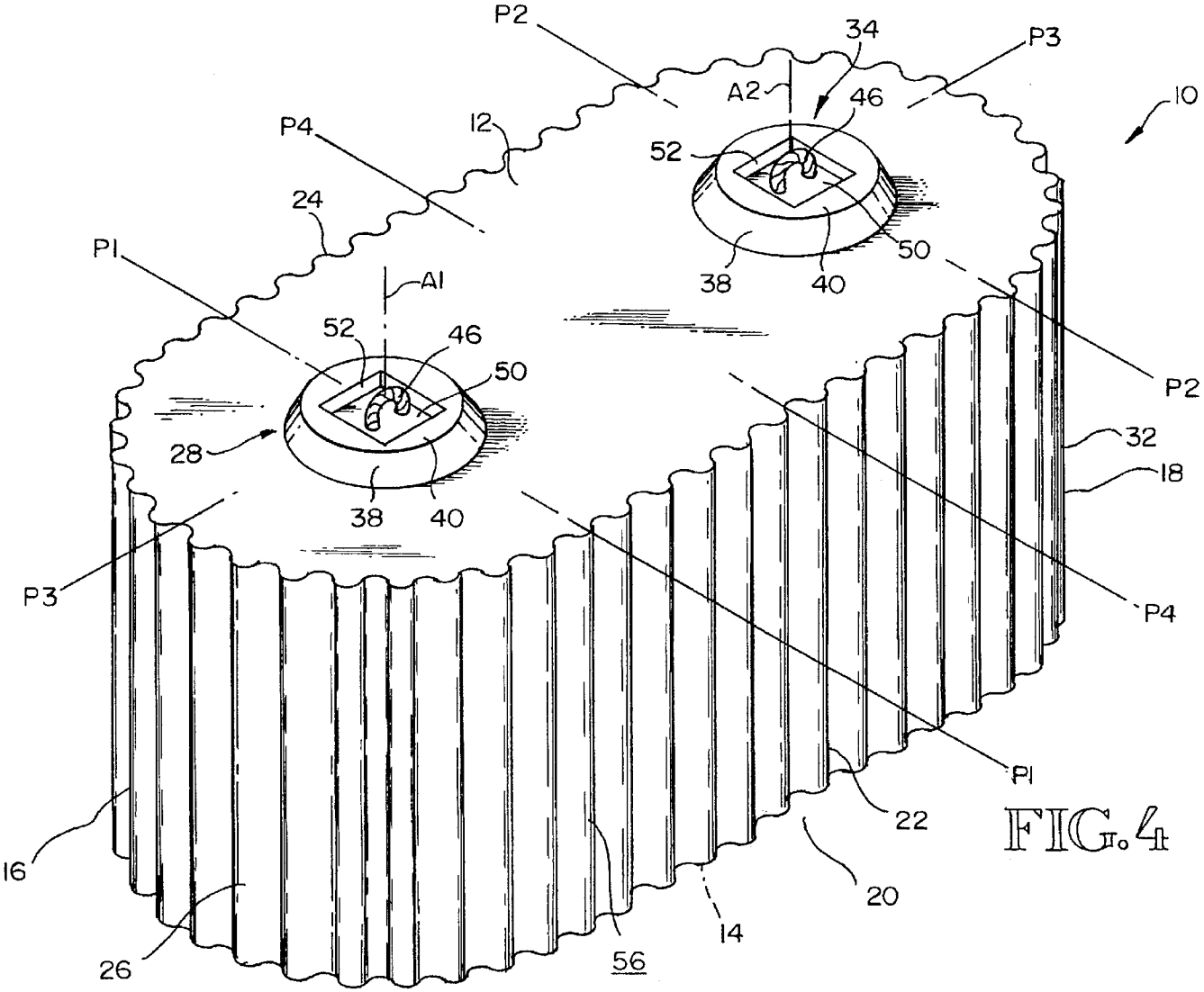
FIG. 4 is a view like FIG. 1 but with an alternate embodiment of the means for lifting the block.

Referring to FIGS. 1, 3 and 4, identical first and second connector pins 28, 34 each have an upwardly tapering sidewall 38 and a circular head 40. The corresponding first and second connector sockets 30, 36 also have an upwardly tapering sidewall 42 and a circular butt plate 44. The connector socket (either 30 or 36) of 10' having the circular butt plate 44 with the tapered sidewall 42 couples with the connector pin (28, 34) having a corresponding circular head 40 and tapered sidewall 38. This circular coupling allows 360 degree radial rotation for placement one atop another.

Referring also to FIG. 2, a lifting eye 46 is formed from a looped cable 48 (FIG. 3 only). Lifting eye 46 extends above top 12, whereas the looped portion of looped cable 48 is buried within block 10. The lifting eye 46 allows the block to be engaged by a lifting device, such as a hook (not shown) or other mechanical device, to facilitate movement and placement of block into mating contact with an adjacent block 10'. In preferred form, lifting eye 46 projects upwardly from a well 50, which is formed from top 12, as shown in FIG. 2. Well 50 includes a plurality of sidewalls 52 and a base portion 54. In preferred form, well 50 is in the shape of a tapered square; however, the shape is immaterial. Well 50 allows lifting eye 46 to be essentially flush with top 12 of block 10, so that lifting eye 46 does not interfere with the structural mating of the blocks. FIG. 4 depicts an alternate embodiment wherein two lifting eyes 46 project from two wells that are formed from first and second connector pins 28, 34.

A decorative surface 56 adorns at least first side 22 and first and second end surfaces 26, 32. In preferred form, the decorative surface is a plurality of ridges and valleys, or otherwise corrugated, although any design may be used. The decorative surface is normally omitted from the second side 24 as second side 24 is retaining dirt/earth and, thus, is unseen.

In preferred form, block 10 weighs approximately 2000 pounds. The distance from axis A1 to axis A2 is approximately four feet and the height of the block, as measured from top 12 to bottom 14, is approximately two feet. However, block 10 is not limited to this weight and dimensions.

An alternate embodiment of block 10 is seen in FIG. 5. Alternate block 11 is a generally cylindrical structure including a circular top 58, a circular bottom 60, and a cylindrical sidewall 62. A connector pin 64, which is shaped the same as first and second connector pins, 28 and 34 respectively, projects from circular top 58. A complementary connector socket 66 is shaped the same as first and second connector sockets, 30 and 36 respectively, enters into circular bottom 60. An axis of generation A3 is located within a transverse vertical plane P5—P5 and perpendicular vertical plane P6—P6. Connector pin 64 and complementary connector socket 66 generate about axis A3. Block 11 has mirror-like symmetry on opposite sides of plane P5—P5 and also on opposite sides of plane P6—P6.

Block 11 may include a means to engage a lifting device such as a cable eye within a well, as shown in FIG. 5, where a lifting eye 46 projects upwardly from a well 50 that is formed from pin 64. As an alternate, not shown, the well could be positioned to one side of pin 64, or, two eyes and two wells could be provided. Each well and its eye would be on diametrically opposite sides of the pin 64. The lifting device would be provided with two hooks, one for each eye.

Block 11 has a decorative surface 68 covering sidewall 62. In preferred form, the decorative surface is a plurality of ridges and valleys, although any design may be used. Decorative surface 68 can, but does not have to, be the same design as decorative surface 56 of block 10.

Block 11 is generally one-half the size of block 10 in weight, height and length. Block 11 may be sized larger or smaller, where one alternative is one-foot high (measured from top 58 to bottom 60).

Referring to FIG. 6, a plurality of blocks 10 and 11 are joined to form a wall 100. A block 10 is mounted adjacent and/or atop of another block 10'. The resulting layers form a plurality of rows 102. First connector pin 28 and second connector pin 34 generally couples with a connector socket of one block 10' and second connector pin 34 can couple with a connector socket of a totally separate block 10". All such couplings can be made without mortar or other adhesives. The use of two blocks 10', 10" atop a single block 10 allows 360 degree rotational stacking of either block 10' or 10", and, thus, the wall can continue at any angle because of the radially rotatable socket and pin connection.

Because alternate block 11 has the same circular connector pin and complementary socket configuration of block 10, block 11 may be interspersed anywhere in the wall, and is particularly useful at the end of every other row, because block 10 is generally resting on portions of two different blocks and eventually a row will be uneven at its end.

Decorative surface 56 and 68 can be seen on all the visible side surfaces of the wall 100, which in preferred form is a continuous pattern of ridges and valleys.

For a finished appearance, alternate top pieces that do not have connector pins may be stacked on top the last row 104 of wall 100. Blocks 70, 72 are the finished blocks of blocks 10, 11, respectively, having a smooth flat surface 71. Surface 71 may be used to walk on, sit on, etc. Blocks 70, 72 are, in preferred form, half the height of blocks 10 and 11. Another alternate block 74 is like that of block 70 except with a hollow interior to be used as a planter block for planting shrubbery, flowers and the like. Blocks 70, 72 and 74 all have the same circular connector sockets so as to mount on top of blocks 10 and 11 on the last row 104 of wall 100 in a multiplicity of angles.

It is to be understood that many variations in size, shape, and construction can be made to the illustrated and above-described embodiment without departing from the spirit and scope of the present invention. Some of the features of the preferred embodiment may be utilized without other features. Therefore, it is to be understood that the presently described and illustrated embodiment is non-limitive and is for illustration only. Instead, my patent is to be limited for this invention only by the following claims interpreted according to accepted doctrines of claim interpretation, including the doctrine of equivalents and reversal of parts.

What is claimed is:

1. A monolithic concrete building block of a size requiring that it be lifted by a powered overhead lifting device, comprising:

a generally cylindrical body having a top, a bottom, and a sidewall;

a connector pin projecting upwardly from said top;

a complementary connector socket entering into said bottom;

a vertical axis of generation about which the pin and the socket are generated;

at least one well located in the top of the block; and means within the block forming an upwardly directed lifting eye within each said well.

2. The block according to claim 1, further comprising a decorative surface adorning said sidewall, said decorative surface comprising ridges and valleys.

3. The block according to claim 1, further comprising one said well located in said pin.

4. A structural wall comprising at least one of a first monolithic concrete building block and at least one of a second monolithic concrete building block, each block of a size requiring that it be lifted by a powered overhead lifting device, said wall comprising:

at least one first block, said first block having a first end portion and a substantially identical second end portion, a central portion between said end portions, a first side, a second side, a top and bottom;

said first end portion having a generally semi-cylindrical first end surface, a first connector pin projecting upwardly from said top, a complementary first connector socket entering into said bottom, and a vertical first axis of generation about which the first pin, the first socket, and the first end surface are generated;

said second end portion having a generally semi-cylindrical second end surface, a second connector pin projecting upwardly from said top, a complementary second connector socket entering into said bottom, and a vertical second axis of generation about which the second pin, the second socket, and the second end surface are generated;

said central portion having first and second side surfaces which extend between the end surfaces of the first block, and said central and end portions providing the block with a generally oblong shape:

said block including at least one well located in the top of each first block;

means within each first block forming an upwardly directed lifting eye within each said well;

at least one second monolithic concrete building block of a size requiring that it be lifted by a powered overhead lifting device, each said second block having a substantially cylindrical shape and having a top, a bottom, a sidewall and a connector pin, of the same size and shape as each pin of each first block, projecting from said top, a complementary connector socket of the same size and shape as each socket of each first block, entering said bottom, a vertical axis of generation about which the connector pin of the second block and the connector socket of the second block are generated, at least one well formed in the top of each said second block, and means within each said second block forming an upwardly directed lifting eye within each said well; and wherein the wall is formed from at least one first block and at least one second block by placing one block atop the other block such that a socket of the top block engages a pin of the block below it.

5. The wall according to claim 4, further comprising a decorative surface adorning at least said first side, and first and second surfaces, all of each first block, and said sidewall of each said second block.

6. The wall according to claim 5, wherein said decorative surface comprises vertical ridges and valleys.

7. A wall according to claim 4, wherein a said well of each said second block is located in each said pin.

8. A structural wall comprising:

at least one first block having a first end portion and a substantially identical second end portion, a central portion between said end portions, a first side, a second side, a top and a bottom;

said first end portion having a generally semi-cylindrical first end surface, a first connector pin projecting upwardly from said top, a complementary first connector socket entering into said bottom, and a vertical first axis of generation about which the first pin, the first socket, and the first end surface are generated;

said second end portion having a generally semi-cylindrical second end surface, a second connector pin projecting upwardly from said top, a complementary second connector socket entering into said bottom, and a vertical second axis of generation about which the second pin, the second socket, and the second end surface are generated;

at least one second block having a first end portion and a substantially identical second end portion, a central portion between said end portions, a first side, a second side, a bottom, said first side, said second side, said bottom, and said end portions defining a hollow interior;

each said first end portion of each said second block having a generally semi-cylindrical first end surface surrounding said hollow interior, a first connector socket, of the same shape and size as each socket of each first block, entering the bottom and a vertical first axis of generation about which the first socket and first end surface are generated; and each said second end portion of each said second block having a generally semi-cylindrical second end surface surrounding said hollow interior, a second connector socket, of the same shape and size as each socket of each first block, entering into said bottom, and a vertical second axis of generation about which the second socket, and the second end surface are generated;

wherein the wall is formed by placing at least one second block atop of at least one first block such that at least one socket of the second block engages at least one pin of the first block.

9. The wall according to claim 8, further comprising at least one third monolithic concrete block, each said third block having a generally cylindrical shape and having a top, a bottom, a sidewall, a connector pin, of the same shape and size as each pin of each first block, projecting upwardly from said top, a complementary socket, of the same shape and size as each socket of each first block, entering into said bottom, a vertical axis of generation about which the pin and the socket are generated, at least one well located in the top of each third block, and means within each third block forming an upwardly directed lifting eye with each said well;

wherein at least one third block is positioned adjacent the at least one first block.

10. The wall according to claim 8, further comprising at least one well located in the top of each said first block;

and means within each first block forming an upwardly directing lifting eye within each said well.

11. The wall according to claim 10, wherein each said well is located in a central portion of each said first block, between the first and second connector pins.

12. The wall according to claim 10, wherein at least one said well is located in said central portion of each said first block, between the first and the second connector pins.

13. The wall according to claim 8, wherein a decorative surface adorns at least said first side and said first and second end surfaces of each said first block and also adorns at least said first side and said first and second end surfaces of each said second block.

14. The wall according to claim 13, wherein said decorative surface comprises vertical ridges and valleys.

15. A monolithic concrete building block of a size required that it be lifted by a powered overhead lifting device, comprising:

substantially identical first and second end portions, a central portion between said end portions, a first side, a second side, a top and a bottom;

said first end portion having a generally semi-cylindrical first end surface, a first connector pin projecting upwardly from said top, a complementary first connectory socket entering into said bottom, and a vertical first axis of generation about which the first pin, the first socket, and the first end surface are generated;

said second end portion having a generally semi-cylindrical second end surface, a second connector pin projecting upwardly from said top, a complementary second connector socket entering into said bottom, and a vertical second axis of generation about which the second pin, the second socket, and the second end surface are generated;

said central portion having first and second side surfaces which extend between the end surfaces of the block, and said central end portions together providing the block with a generally oblong shape;

said block including at least two wells located at the top, wherein one said well is located in each of said pins; and means within the block forming an upwardly directing lifting eye within each said well.

16. A structural wall comprising a plurality of monolithic concrete building blocks, each of a size requiring that it be lifted by a powered overhead lifting device, each said concrete block comprising:

a first end portion and a substantially identical second end portion, a central portion between said end portions, a first side, a second side, a top and a bottom;

said first end portion having a generally semi-cylindrical first end surface, a first connector pin projecting upwardly from said top, a complementary first connector socket entering into said bottom, and a vertical first axis of generation about which the first pin, the first socket and the first end surface are generated;

said second end portion having a generally semi-cylindrical second end surface, a second connector pin projecting upwardly from said top, a complementary second connector socket entering into said bottom, and a vertical second axis of generation about which the second pin, the second socket, and the second end surface are generated;

said central portion having first and second side surfaces which extend between the end surfaces of the block, and said central and end portions providing the block with a generally oblong shape;

said block including at least two wells located in the top of the block, wherein one said well is located in each of said pins; and means within the block forming an upwardly directing lifting eye within each said well;

wherein one concrete block is mounted atop another concrete block and one of its said sockets engages a pin on the block below it.

* * * * *